US009538812B2

(12) United States Patent
Torrance et al.

(10) Patent No.: US 9,538,812 B2
(45) **Date of Patent: *Jan. 10, 2017**

(54) ADJUSTABLE SOLE SUPPORT SYSTEM

(71) Applicant: DashAmerica, Inc., Louisville, CO (US)

(72) Inventors: Tony Torrance, Boulder, CO (US); Philip Majure, Louisville, CO (US); Robert K. Scofield, Lake Oswego, OR (US)

(73) Assignee: DASHAMERICA, INC., Louisville, CO (US)

( * ) Notice: Subject to any disclaimer, the term of this patent is extended or adjusted under 35 U.S.C. 154(b) by 346 days.

This patent is subject to a terminal disclaimer.

(21) Appl. No.: 14/187,793

(22) Filed: Feb. 24, 2014

(65) Prior Publication Data

US 2014/0165424 A1 Jun. 19, 2014

Related U.S. Application Data

(63) Continuation of application No. 12/852,501, filed on Aug. 8, 2010, now Pat. No. 8,667,716, which is a continuation-in-part of application No. 11/701,090, filed on Jan. 31, 2007, now Pat. No. 7,770,309.

(51) Int. Cl.

| | |
|---|---|
| ***A43B 13/38*** | (2006.01) |
| ***A43B 3/00*** | (2006.01) |
| ***A43B 7/14*** | (2006.01) |
| ***A43B 17/02*** | (2006.01) |
| ***A43D 999/00*** | (2006.01) |

(52) U.S. Cl.

CPC ..... *A43B 13/386* (2013.01); *A43B 3/0031* (2013.01); *A43B 7/142* (2013.01); *A43B 7/148* (2013.01); *A43B 7/1465* (2013.01); *A43B 17/02* (2013.01); *A43D 999/00* (2013.01)

(58) Field of Classification Search

CPC ..... A43B 7/142; A43B 7/1425; A43B 7/1445; A43B 7/1465

See application file for complete search history.

(56) References Cited

U.S. PATENT DOCUMENTS

| | | | | | |
|---|---|---|---|---|---|
| 1,469,607 | A | * | 10/1923 | Scholl | A43B 7/142 36/159 |
| 1,797,143 | A | * | 3/1931 | Havey | A43B 7/142 36/164 |
| 1,941,713 | A | * | 1/1934 | Parsons | A43B 7/1445 36/164 |
| 2,057,510 | A | * | 10/1936 | Block | A43B 7/14 36/159 |
| 2,600,864 | A | * | 6/1952 | Fuller | A43B 7/1415 2/239 |
| 2,965,984 | A | * | 12/1960 | Scholl | A43B 7/142 36/164 |

(Continued)

*Primary Examiner* — Ted Kavanaugh

(74) *Attorney, Agent, or Firm* — Jeffer Mangels; Butler & Mitchell LLP; Brennan C. Swain, Esq.

(57) ABSTRACT

A removable and adjustable insert for footwear has slots placed in the insole and/or midsole of the shoe to allow access to the arch and/or metatarsal and/or heel regions of the insole and/or midsole. In an embodiment, an insert placed into the arch insert slot that establishes how much the arch protrudes above the remainder of the top surface of the insole. One or more inserts are provided having different thicknesses so that the height of the arch can be varied by the user or at the direction of a third party, such as a doctor or a trainer.

13 Claims, 3 Drawing Sheets

(56) References Cited

U.S. PATENT DOCUMENTS

| | | | | |
|---|---|---|---|---|
| 5,138,774 | A * | 8/1992 | Sarkozi | A43B 7/14 36/159 |
| 7,770,309 | B2 * | 8/2010 | Scofield | A43B 7/142 36/159 |
| 8,667,716 | B2 * | 3/2014 | Torrance | A43B 3/0031 36/159 |
| 2008/0178493 | A1 * | 7/2008 | Scofield | A43B 7/142 36/43 |

* cited by examiner

ADJUSTABLE SOLE SUPPORT SYSTEM

CROSS REFERENCE TO RELATED APPLICATION

This application is a continuation of U.S. patent application Ser. No. 12/852,501, filed Aug. 8, 2010, entitled "Adjustable Sole Support System" which is a continuation-in-part of U.S. patent application Ser. No. 11/701,090, filed on Jan. 31, 2007, entitled "Adjustable Arch Insole" which is hereby incorporated by reference in its entirety.

FIELD OF THE INVENTION

The invention relates to footwear, including shoes, boots, sandals, etc. In particular, the invention relates to systems and methods for allowing a user to adjust the amount of support in the metatarsal, arch and heel portion of the insole or midsole of footwear.

BACKGROUND OF THE INVENTION

Different people need different amounts of support in the footwear they wear. In addition, an individual wearer's need for support can vary such that occasionally more or less support may be desirable. For example, in some situations, it may be beneficial to have additional arch support for the wearer, while the support in the heel would be minimized. Alternatively, the wearer may desire to have no support in the heel portion of the sole, but a greater varus angle in the metatarsal region. To accomplish these variations in support and angles, the wearer would be required to purchase footwear configured to each situation or purchase several insoles configured to each situation. Furthermore, some footwear inserts are not held in place, and move out of position causing discomfort to the user.

Another challenge of footwear design is the need to accommodate a wide variety of foot shapes and dimensions, which vary from person to person, while providing a product that is economical. Human feet tend to encompass a wide variety of characteristics including volume, length, arch height, toe dimensions, and various protrusions. The variance in these characteristics causes people's feet to differ significantly from one another and sometimes from foot to foot. To properly provide optimal support characteristics, it is necessary for the article of footwear to correspond as closely as possible to the unique dimensions of a user's foot. An improperly-fitting article of footwear will likely cause pain, injury and damage to a user's foot, leg(s), back, and neck. Therefore, various systems and methods are used to facilitate selecting and/or adjusting existing footwear for a user.

In order to accommodate a wide variety of foot shapes and dimensions, the seller of the footwear or the insole would be required to carry a large inventory having multiple variations of arch support, metatarsal support and heel support of the footwear or insole because these support regions could not be adjusted by the user or at the direction of a third party (such as a doctor or a trainer), which would significantly increase the cost and inventory of the seller and subsequently the consumer.

Thus, there is a need for an adjustable sole support system, in the midsole or in the insole, which allows the user to individually adjust the support in the metatarsal, arch and heel regions. Furthermore, there is a need for an adjustable sole support system, in the insole and the midsole, which allows the user to adjust these regions for use in different activities.

BRIEF SUMMARY OF THE INVENTION

The present invention overcomes the problems of the prior art by providing an insole, which may be removable, and is configured to accept inserts or angled inserts into slots in the metatarsal, arch and/or heel portions of the insole. A plurality of inserts are provided such that the user may choose to use an insole without any inserts, provide inserts to one portion of the insole or provide several inserts to several portions of the insole. The user may also vary the thickness and angle of the inserts by using a plurality of inserts in the insole slots. Additionally, because the insole contains slots for the inserts, which are shaped to accept the inserts, the inserts remain correctly positioned in the insole during use.

In some configurations, the midsole of a shoe is configured to accept padding or angled inserts into slots in the metatarsal, arch and/or heel portions of the midsole.

In some configurations, a cover is provided to prevent debris and/or particulates from entering the slots in the midsole of the shoe or insole.

The foregoing and other objectives, features, and advantages of the invention will be more readily understood upon consideration of the following detailed description of the invention, taken in conjunction with the accompanying drawings.

DETAILED DESCRIPTION

Figure 1:
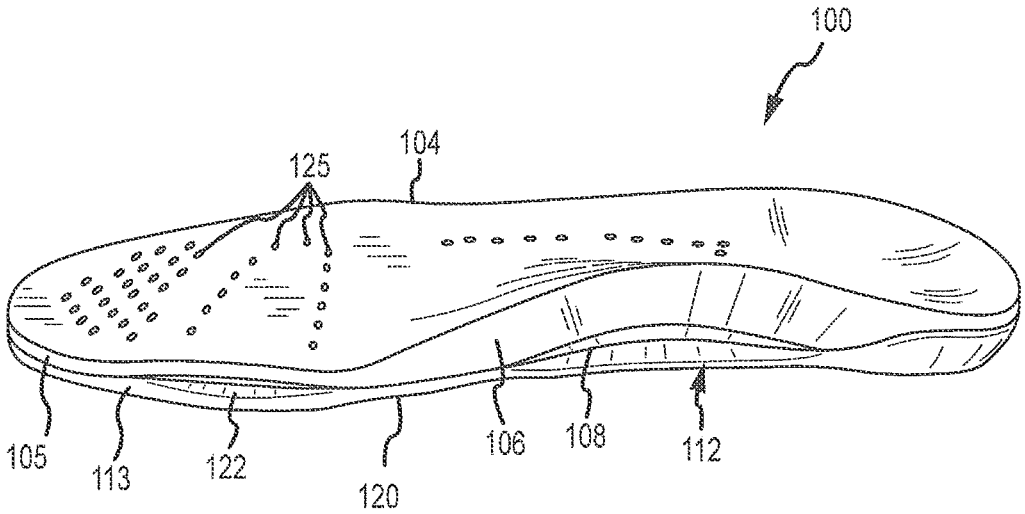
FIG. 1 illustrates a side elevation view of the insole without inserts.
Figure 2:
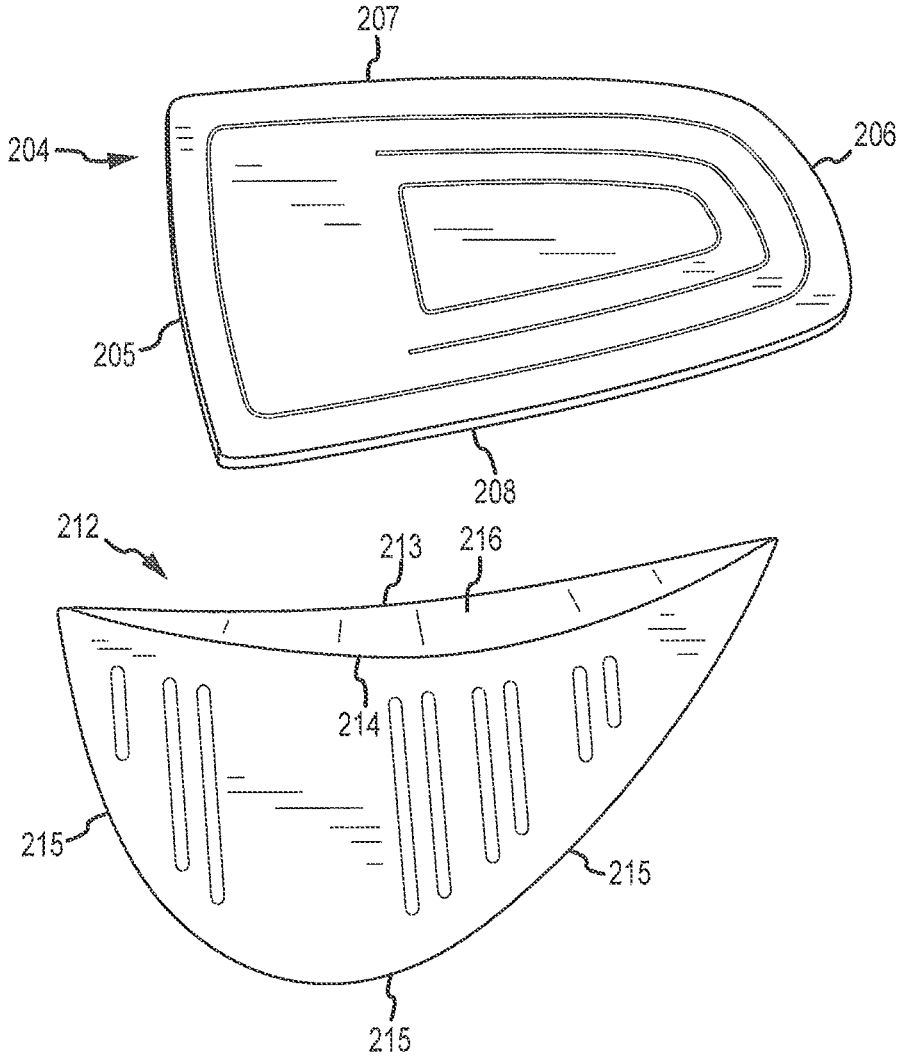
FIG. 2 is a plain view of an arch wedge insert and a metatarsal insert.
Figure 3:
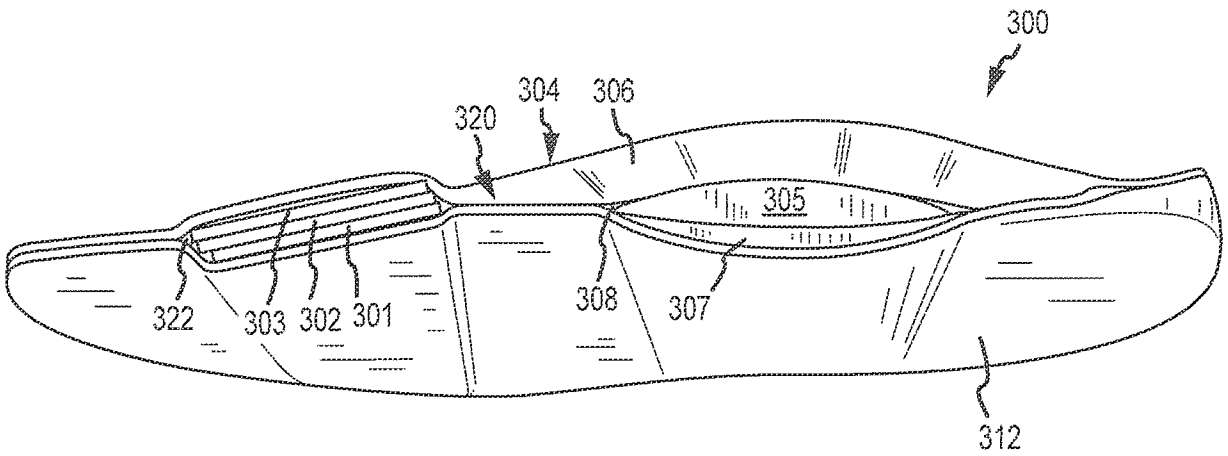
FIG. 3 is a medial elevation side view of the insole with arch and metatarsal inserts.

FIGS. 1, 2 and 3 depict specific embodiments of the present invention. FIGS. 1, 2 and 3 illustrate different embodiments of the present invention that may be both left and right forms of an insole and inserts and include insoles and inserts designed to fit a man, a woman, or both. The insole of the invention may have a shoe size according to any international shoe size designation. Alternatively, the insole may be fixed to a shoe or sandal while maintaining access to an adjustable insole support system within the insole of the shoe or sandal. Alternatively, the inserts may be inserted into the midsole of a shoe rather than into the insole.

Referring to the drawings, FIG. 1 shows an adjustable insole support system that includes an insole 100 which is configured to fit within a shoe, boot or other type of footwear. The insole 100 has a bottom surface 112 which is generally planar and rests on the bottom of the footwear upper (top of the outersole—not shown) when the insole is inserted into the footwear. The insole has a top surface 104 which may be generally planar and is parallel with the bottom surface 112 over the entire insole 100. Top surface 104 is engaged to first layer 105, that is the bottom of top surface 104 is attached to first layer 105 at the upper surface of first layer 105. Bottom surface 112 is engaged to second layer 113, that is the top of bottom surface 112 is attached to second layer 113 at the bottom surface of second layer 113. The first layer 105 and the second layer 113 may be attached to each other at various locations of the bottom of first layer 105 and top of second layer 113. The top surface 104 and the bottom surface 112 may be attached to respective first layer 105 and second layer 113 by heat mold, gluing, VELCRO®, embossed seams, welded seams, bonded seams, adhesive seals, stitched seams, or a combination thereof. The top surface 104 and the bottom surface 112 may be attached so as to allow insert slots as discussed below. Other methods to form a metatarsal insert slot, an arch insert slot and/or heel insert slot are discussed in greater detail below.

In another embodiment, the first layer 105 of the insole 100 may contain a protruding semi-circular arch 106 along its central medial edge 120. As will be more fully explained later, the arch 106 in the insole 100 is less than the arch normally provided in footwear. The foot of a user rests on top of the top surface 104 of the insole 100 with the arch 106 extending upwardly against the user's foot.

The insole 100 preferably is molded from a polyurethane foam or similar material to provide an appropriate combination of support and comfort to the user, however, the insole 100 may be leather, canvas, rubber, EVA, polyester, nylon, nylon textiles, thermoplastic polyurethane or any other suitable material. Furthermore, the insole 100 may contain additional materials or material layers for antimicrobial or antifungal protection, or fragrances. These materials or layers may be located on the top surface 104 and/or the first layer 105 of the insole 100, on the bottom surface 112 and/or second layer 113 of the insole 100 or between the top surface 104 and the bottom surface 112 of the insole 100. The additional layers may be attached to the insole 100 by any suitable means, including, but not limited to, heat mold, gluing, VELCRO®, embossed seams, welded seams, bonded seams, adhesive seals, stitched seams, or a combination thereof. The additional layers may be removable so that they may be replaced by the user. Furthermore, the additional layers may span the entire width and length of the insole 100, or may cover only a portion of the insole 100.

Optional holes 125 may also be located on either the top surface 104 of the insole 100 or the bottom surface 112 of the insole 100 and may extend through the entire thickness of the insole 100. The holes 125, may reduce the weight of the insole 100. Alternatively, the holes 125 may provide breathability of the insole 100.

Located in the insole 100 between the top surface 104 and bottom surface 112 under the arch 106 is an arch insert slot 108. The arch insert slot 108 may be any suitable shape, but preferably is semi-circular and underlies the entire arch 106. As illustrated in FIG. 1, the arch insert slot 108 opens out of medial edge 120 of the insole 100. FIG. 1 illustrates the arch insert slot 108 near the bottom of the medial edge 120 of the insole 100, but may also it could be located at different locations along the medial edge 120 as desired. In one embodiment, when no inserts are placed into the metatarsal slot, the first layer 105 of the insole 100 and the second layer 113 of the insole 100 come into contact with each other or the one or more of the additional layer(s) as described above.

In another embodiment where no arch inserts are used, it is possible for the arch 106 to provide some arch support to the user.

In another embodiment, the slot is located on the lateral edge of the insole. In this embodiment, the inserts may be inserted such that they are substantially flush with the medial edge of the insole in the arch region.

In another embodiment of the invention, the arch insert slot extends from the medial edge to the lateral edge, allowing the user to introduce the inserts from either the medial edge or the lateral edge.

In another embodiment, the arch insert slot is accessible from the bottom of the insole, such that no slot exists on either the medial or lateral edge of the insole.

In another embodiment, the arch insert slot extends on the bottom of the insole, the medial edge of the insole and/or the lateral edge of the insole. A cover may be included in any of the previously described embodiments, to cover the arch insert slot to prevent debris and particles from entering the arch insert slot.

Located in the insole between the top surface 104 and the bottom surface 112 under the metatarsal region of the insole 100 is the metatarsal insert slot 122. The metatarsal insert slot 122 may be any suitable shape, but preferably is substantially trapezoidal in shape, though the metatarsal insert slot 122 could be rectangular or semi-circular and underlies a substantial portion, if not the entire, metatarsal region. As illustrated in FIG. 1, the metatarsal insert slot 122 opens out of medial edge 120 of the insole 100. In one embodiment, when no inserts are placed in the metatarsal slot, the first layer 105 of the insole 100 and the second layer 113 of the insole 100 come into contact with each other or additional layer(s), as described above. In the embodiment illustrated in FIG. 1, the metatarsal slot is centrally located between the top surface 104 and the bottom surface 112 of the insole, but may be within either the first layer 105 or the second layer 113 of the insert as desired. In another embodiment, the metatarsal insert slot is located on the lateral edge of the insole. In this embodiment, the inserts are inserted such that they are substantially flush with the medial edge of the insole in the metatarsal region. In another embodiment of the invention, the metatarsal insert slot extends from the medial edge to the lateral edge, allowing the user to introduce the inserts from either the medial edge or the lateral edge of the insole. In another embodiment, the metatarsal insert slot is accessible from the bottom of the insole, such that no slot exists on either the medial or lateral edge of the insole. In another embodiment, the metatarsal insert opening is positioned on the bottom of the insole, the medial edge of the insole and/or the lateral edge of the insole. A cover may be included in any of the previously described embodiments, to cover the metatarsal insert slot to prevent debris and particles from entering the metatarsal insert slot.

In one configuration, the insole contains cutouts near the metatarsal region so as to allow less padding due to the insole. This configuration is useful for transferring power between the user and, for example, a bicycle pedal. In this configuration, rigid inserts may be used with the insole such that the insole sufficiently holds the insert in place, though with minimal or no padding between the user and the top surface of the insole and/or between the bottom surface of the insole and the top surface of the insole.

Though not illustrated in FIG. 1, the insole may contain a heel insert slot located in the insole between the top surface and the bottom surface under the heel region of the insole. The heel insert slot may be any suitable shape, but preferably is substantially circular, though could be rectangular or semi-circular and underlies a substantial portion, if not the entire, heel region of the insole. The heel insert slot may open through the back edge of the insole. In one embodiment, when no inserts are placed into the heel slot, the first layer of the insole and the second layer of the insole come into contact with each other or additional layer(s), as described above. In one embodiment the heel slot is generally located near the center of the medial edge of the insole but it may be higher or lower in the elevation profile as desired. In another embodiment, the heel insert slot is located on the lateral edge of the insole. In another embodiment, the heel insert is located on the medial edge of the insole. In another embodiment, the heel insert slot is accessible from the bottom of the insole, such that no slot exists on either the medial, back edge or lateral edge of the insole. In another embodiment, the heel insert slot exists on the bottom of the insole, the back edge of the insole, the medial edge of the insole and/or the lateral edge of the insole. A cover may be included in any of the previously described embodiments, a cover may be used over the heel insert slot to prevent debris and particles from entering the heel insert.

The metatarsal insert slot, arch insert slot and heel insert slot can be formed in the insole in several different ways. In one embodiment, a first layer of the insole and a second layer of the insole may be joined together, leaving openings for the metatarsal insert slot, the arch insert slot and/or the heel insert slot. The first layer of the insole and the second layer of the insole are joined together using any suitable means to secure the first layer to the second layer. By way of example, the top surface and the bottom surface may be attached by, heat mold, gluing, VELCRO®, embossed seams, welded seams, bonded seams, adhesive seals, stitched seams, or a combination thereof. In another embodiment, the insole is formed out of one continuous material to form a top surface and a bottom surface. The metatarsal insert slot, the arch insert slot and/or the heel insert slot may be formed using a slider to create an opening in the insole. A slider, as defined herewith, is a portion of the mold that is inserted during an injection molding process that allows the area of the insert to be absent of material. Once the cycle time of the material being molded is met, the slider can be removed so that the part can be removed from the mold. In some embodiments, the insole is poured into a mold to create the opening. In another configuration, the material is injected into a mold to create an opening. In another configuration, the inserts are cut out of the continuous insole after the insole is formed. The metatarsal insert slot, the arch insert slot and/or the heel insert slot may be formed using similar methods in the midsole.

In some embodiments, the metatarsal insert slot, the arch insert slot and/or the heel insert slot are substantially similar in shape to the inserts, which aids in holding the inserts in place during use.

The adjustable insole support system may include any combination of the metatarsal insert slot, arch insert slot or heel insert slot, or all of these insert slots.

The adjustable insole support system may also include a plurality of inserts, which may be chosen by the user to adjust the level of support in the metatarsal, arch and heel regions. In a preferred embodiment, the inserts generally have the same shape as the insert slot that they fit into so that they can be inserted into the slot and substantially fill the slot in order to provide support and comfort for the user. The inserts may be used individually, or they may be stacked with other inserts to vary the thickness of the inserts. The inserts may be any suitable material, but are preferably a substantially pliable material, such as a foam, including a ethylene vinyl acetate foam or other open cell foams or cork or other polymer materials. The inserts may also be made of rubber, canvas, leather, EVA, nylon, polyester, nylon textiles, thermoplastic polyurethane, composites, laminates or other suitable structural material or combinations thereof. The insert(s) may be colored, or may be translucent. In certain embodiments, it is preferable for the inserts to be substantially rigid so as to transfer power, for example, while the user is pedaling a bicycle. In this configuration, the inserts may be a substantially rigid material, including but not limited to a polymer, a metal or wood. Furthermore, the inserts may contain additional materials or material layers for antimicrobial or antifungal protection, or fragrances.

FIG. 2 illustrates embodiments of the metatarsal and heel inserts of the present invention. Metatarsal insert 204 has generally the same shape as the metatarsal insert slot that it fits into. The metatarsal insert 204 may have a substantially constant thickness from the metatarsal insert medial edge 205 to the metatarsal insert lateral edge 206. In another embodiment, the metatarsal insert medial edge 205 may be thicker than the metatarsal insert lateral edge 206. For purposes of this application when an insert is said to have a specific thickness it refers to its maximum thickness. In another embodiment, the thickness may be substantially constant from the top edge 207 of the metatarsal insert 204 to the bottom edge 208 of the metatarsal insert 204. In another embodiment, both the thickness from the top edge 207 of the metatarsal insert 204 to the bottom edge 108 of the metatarsal insert 204 and the thickness from the medial edge 205 to the lateral edge 206 vary. In a preferred embodiment, the insert 204 has a variable thickness where the maximum thickness at the medial edge 205 is no more than approximately ⅕ of an inch (approximately 5 mm). Preferably, when a metatarsal insert 204 is in the metatarsal insert slot its medial edge 205 is flush with the medial side of the insole. Though the inserts will be at a set thicknesses, the thickness of the inserts can be varied in the insole by combining multiple inserts and inserting them into the metatarsal insert slot of the insole.

FIG. 2 also illustrates the arch insert 212. Though the right arch insert is illustrated in FIG. 2, as explained above, the present invention may be both left and right forms of an insert. In a preferred embodiment, the insert 212 is the thickest at the center of the medial edge 216 and the thinnest at its periphery 215. In the embodiment illustrated in FIG. 2, the arch insert 212 has a semi-circular center portion where the thickness varies gradually and a semi-annular outer section where the thickness varies rapidly. For purposes of this application when an insert is said to have a specific thickness it refers to its maximum thickness. Preferably when an insert is in the slot its outer edge 216 is flush with the medial side of the insole. Though the insert may be any suitable thickness, in the preferred embodiment, the thickness is no more than approximately ⅜-⅗ of an inch (approximately 12 mm or 1.2 cm). Though the inserts will be at a set interval range of thicknesses, the thickness of the inserts can be varied in the insole by combining multiple inserts and inserting them into the arch insert slot of the insole. In one embodiment, the insole is sized such that when the insert 212 with a thickness of approximately 3⁄16 of an inch (approximately 5 mm) and the arch of the insole are used, the total arch thickness is approximately ⅜-⅗ of an inch (approximately 10 mm-15 mm). By adding additional inserts 212 to this configuration, the size of the arch is increased above its normal size. By decreasing the size of the insert 212 below approximately 3⁄16 of an inch (approximately 5 mm), the size of the arch is decreased below this thickness. Though thicker and thinner inserts 212 may be used, generally the thickness will vary between approximately 0.15-0.35 inch (approximately 4 mm-8 mm).

A heel insert may be used in the adjustable insole support system. As described above, the heel insert may be any suitable shape, but preferably is circular, though could be rectangular or semi-circular and underlies a substantial portion, if not the entire, heel region of the insole. Similar to the metatarsal inserts and the arch inserts, the heel inserts will be available in a variety of different sizes and can be combined to create the correct amount of cushion and support as determined by the user.

As described above, the several inserts may be combined to make the appropriate size insert as determined by the user. FIG. 3 illustrates the insole 300 containing several metatarsal and arch inserts. As illustrated in FIG. 3, the insole 300 comprises a metatarsal insert slot 322 and an arch insert slot 308 between the top surface 304 and the bottom surface 312 of the insole 300. Three metatarsal inserts 301, 302 and 303 are shown within the metatarsal insert slot 322 and are substantially flush with the medial edge 320 of the insole 300. Though three metatarsal inserts 301, 302 and 303, are illustrated in FIG. 3, it is understood that any number of inserts may be used. The optional arch 306 is also illustrated in the insole 300. Two arch inserts 305 and 307 are illustrated in this embodiment. Though two arch inserts 305 and 307 are illustrated in FIG. 3, it is understood that any number of inserts may be used.

The adjustable insole support system allows a shoe to have variable arch, metatarsal and/or heel support that is adjustably sized to work for the particular user without having to use multiple insoles, each sized for different applications. In addition, the arch, metatarsal and/or heel support can be changed to address problems that might occur or the need for more support in the insole. Furthermore, in some embodiments, the insole is compatible with different shoes.

In one embodiment, the inserts may be incorporated directly into the midsole of the footwear, such as a shoe, boot or sandal. Though in some embodiments, the insole attaches directly to the footwear, in other embodiments, the inserts are incorporated into the midsole of the footwear. In some embodiments, the midsole of the footwear may contain a midsole capable of accepting inserts into the midsole of the footwear. In some embodiments, the metatarsal insert slot, the arch insert slot and the heel insert slot contain a cover, which substantially protects the respective slots from receiving particles or debris. Other embodiments may include an arch insert slot within the midsole and/or a metatarsal insert slot and/or a heel insert slot. Each of these slots may contain a cover to protect the insert slots from receiving debris or particles.

In some embodiments, the adjustable support system, including the insole and inserts, are combined as a kit. The kit may include the insole (as described in several embodiments above), and one or more inserts (as described in several embodiments above) for use in the insole. Depending upon the insole insert slots present in the insole (i.e. metatarsal insole slot, arch insole slot and heel insert slot), the kits may be tailored to include several inserts of varying thickness for use with the insole. In other configurations, the inserts (as described in several embodiments above) are combined as a kit, with variable thicknesses of inserts, for use in either the insole and/or the midsole.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A footwear support system comprising:

a molded insert insole comprising a semicircular arch along a central medial edge and an insole thickness with at least one first layer joined to at least one second layer, wherein the at least one first layer and the at least one second layer are configured to form a semi-circular arch insert slot between the at least one first layer and the at least one second layer, wherein the semicircular arch has a thickness of at least most of the insole thickness wherein the semi-circular arch insert slot at least partially underlies the semicircular arch; and at least one arch insert, wherein the at least one arch insert is configured to fit into the arch insert slot, the at least one arch insert having a thickness and an outer edge surface, whereby the at least one arch insert engages the arch insert slot and the outer edge surface defines a continuous exterior edge of the insole when engaged with the arch insert slot, the insert of a pliable material, the insert comprising a semi-circular center portion wherein the thickness varies of lesser rate than a semi-circular outer section.

2. The footwear support system of claim 1, wherein the at least one arch insert is semicircular.

3. The footwear support system of claim 1, further comprising:

at least one metatarsal insert slot formed in at least one layer of the at least one first layer and the at least one second layer; and at least one metatarsal insert, wherein the at least one metatarsal insert is configured to fit at least partially into the at least one metatarsal insert slot.

4. The footwear support system of claim 3, wherein the at least one metatarsal insert slot extends over a portion of a metatarsal region of the insole.

5. A shoe which incorporates the footwear support system of claim 1.

6. The footwear support system of claim 1, wherein the at least one arch insert is a plurality of inserts of thickness between approximately 4 mm-8 mm.

7. A footwear support system comprising:

a molded insert insole comprising a semicircular arch along a central medial edge and an insole thickness with at least one first layer joined to at least one second layer, wherein the at least one first layer and the at least one second layer are configured to form a semi-circular arch insert portion between the at least one first layer and the at least one second layer, wherein the semicircular arch has a thickness of at least most of the insole thickness wherein the semi-circular arch insert portion at least partially underlies the semicircular arch; and at least one arch insert, wherein the at least one arch insert is configured to engage the arch insert portion, the at least one arch insert having a thickness and an outer edge surface, whereby the at least one arch insert engages the arch insert portion and the outer edge surface defines a continuous exterior edge of the insole when engaged with the arch insert portion, the insert of a pliable material, the insert comprising a semi-circular center portion wherein the thickness varies of lesser rate than a semi-circular outer section.

8. The footwear support system of claim 7, wherein the at least one arch insert is semicircular.

9. A shoe which incorporates the footwear support system of claim 7.

10. A footwear support system comprising:

a molded insole having an insole thickness, wherein the insole comprises a semicircular arch along a central, medial edge of the insole, wherein the semicircular arch comprises a first thickness of at least most of the insole thickness, wherein the insole further comprises a semi-circular slot about a lower surface of the insole along the central, medial portion of the insole, whereby the semicircular slot at least partially underlies the semi-circular arch; and at least one removable semicircular insert having a second thickness and outer edge surface, whereby the at least one insert engages the semicircular slot and is flush with the central, medial edge of the insole, the outer edge surface defining a continuous exterior edge of the insole when engaged with the semicircular slot, the insert of a pliable material, the insert comprising a semi-circular center portion.

11. The footwear support system of claim 10, wherein the second thickness varies of lesser rate than a semi-circular outer section of the at least one insert.

12. A shoe which incorporates the footwear support system of claim 11.

13. The footwear support system of claim 1, wherein the semicircular arch thickness is greater than the insole thickness.

* * * * *